US005641618A

United States Patent [19]

Wen et al.

[11] Patent Number: 5,641,618

[45] Date of Patent: Jun. 24, 1997

[54] EPITAXIALLY SENSITIZED ULTRATHIN DUMP IODIDE TABULAR GRAIN EMULSIONS

[75] Inventors: Xin Wen; Richard Lee Daubendiek, both of Rochester; Donald Lee Black, Webster; Joseph Charles Deaton, Rochester; Timothy Richard Gersey, Rochester; Joseph George Lighthouse, Rochester; Myra Toffolon Olm, Webster; Robert Don Wilson, Rochester, all of N.Y.

[73] Assignee: Eastman Kodak Company, Rochester, N.Y.

[21] Appl. No.: 590,961

[22] Filed: Jan. 24, 1996

Related U.S. Application Data

[63] Continuation-in-part of Ser. No. 441,488, May 15, 1995, abandoned.

[51] Int. Cl.[6] ..... G03C 1/035

[52] U.S. Cl. ..... 430/567; 430/570

[58] Field of Search ..... 430/567, 569, 430/570

[56] References Cited

U.S. PATENT DOCUMENTS

| | | | |
|---|---|---|---|
| 4,433,048 | 2/1984 | Solberg et al. | 430/434 |
| 4,434,226 | 2/1984 | Wilgus et al. | 430/567 |
| 4,435,501 | 3/1984 | Maskasky | 430/434 |
| 4,439,520 | 3/1984 | Kofron et al. | 430/434 |
| 5,061,616 | 10/1991 | Piggin et al. | 430/569 |
| 5,087,555 | 2/1992 | Saitou | 430/569 |
| 5,132,203 | 7/1992 | Bell et al. | 430/567 |
| 5,250,403 | 10/1993 | Antoniades et al. | 430/505 |
| 5,252,442 | 10/1993 | Dickerson et al. | 430/567 |
| 5,254,453 | 10/1993 | Chang | 430/567 |
| 5,272,052 | 12/1993 | Maskasky | 430/567 |
| 5,314,793 | 5/1994 | Chang et al. | 430/509 |
| 5,358,840 | 10/1994 | Chaffee et al. | 430/567 |
| 5,360,703 | 11/1994 | Chang et al. | 430/509 |
| 5,418,125 | 5/1995 | Maskasky | 430/569 |
| 5,470,698 | 11/1995 | Wen | 430/567 |
| 5,494,789 | 2/1996 | Daubendick et al. | 430/567 |
| 5,503,971 | 4/1996 | Daubendiek et al. | 430/567 |

OTHER PUBLICATIONS

Buhr et al *Research Disclosure* vol. 253, Item 25330, May 1985.

*Primary Examiner*—Lee C. Wright
*Attorney, Agent, or Firm*—Carl O. Thomas

[57] ABSTRACT

An improved spectrally sensitized ultrathin tabular grain emulsion is disclosed in which tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, are spectrally sensitized and improved by employing dump iodide host tabular grains and, in forming the surface chemical sensitization sites, at least one silver salt epitaxially located on the tabular grains.

A photographic element is disclosed comprised of a support, a first silver halide emulsion layer coated on the support and sensitized to produce a photographic record when exposed to specular light within the minus blue visible wavelength region of from 500 to 700 nm, a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of the improved spectrally sensitized ultrathin tabular grain emulsion of the invention.

The ultrathin dump iodide tabular grain emulsions with silver salt epitaxy chemical sensitization have been observed to produce larger than expected speed increases, to produce higher than expected contrasts, to be unexpectedly specularly transmissive and therefore compatible with forming sharp photographic images in underlying emulsion layers, to exhibit a higher percentage of total light absorption in the wavelength region of maximum absorption by the spectral sensitizing dye or dyes employed, and to exhibit a surprising tolerance of inadvertent manufacturing variances.

17 Claims, No Drawings

EPITAXIALLY SENSITIZED ULTRATHIN DUMP IODIDE TABULAR GRAIN EMULSIONS

This is a Continuation-In-Part of application Ser. No. 08/441,488, filed 15 May 1995 now abandoned.

FIELD OF THE INVENTION

The invention relates to silver halide photography. More specifically, the invention relates to improved spectrally sensitized silver halide emulsions and to multilayer photographic elements incorporating one or more of these emulsions.

BACKGROUND

Kofron et al U.S. Pat. No. 4,439,520 (which incorporates the emulsions of Wilgus et al U.S. Pat. No. 4,434,226 and Solberg et al U.S. Pat. No. 4,433,048) ushered in the current era of high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed.

An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver salt epitaxy to selected sites, typically the edges and/or corners, of the host grains. Depending upon the composition and site of the silver salt epitaxy, significant increases in speed were observed.

In 1982 the first indirect radiographic and color photographic films incorporating the teachings of Kofron et al were introduced commercially. Now, 12 years later, there are clearly understood tabular grain emulsion preferences that are different, depending on the type of product being considered. Indirect radiography has found exceptionally thin tabular grain emulsions to be unattractive, since they produce silver images that have an objectionably warm (i.e., brownish black) image tone. In camera speed color photographic films exceptionally thin tabular grain emulsions usually have been found attractive, particularly when spectrally sensitized to wavelength regions in which native grain sensitivity is low—e.g., at wavelengths longer than about 430 nm. Comparable performance of exceptionally thin tabular grain emulsions containing one or more spectral sensitizing dyes having an absorption peak of less than 430 nm is theoretically possible. However, the art has usually relied on the native blue sensitivity of camera speed emulsions to boost their sensitivity, and this has retarded the transition to exceptionally thin tabular grain emulsions for producing blue exposure records. Grain volume reductions that result from reducing the thickness of tabular grains work against the use of the native blue sensitivity to provide increases in blue speed significantly greater than realized by employing blue absorbing spectral sensitizing dyes. Hence, thicker tabular grains or nontabular grains are a common choice for the blue recording emulsion layers of camera speed film.

Recently, Antoniades et al U.S. Pat. No. 5,250,403 disclosed tabular grain emulsions that represent what were, prior to the present invention, in many ways the best available emulsions for recording exposures in color photographic elements, particularly in the minus blue (red and/or green) portion of the spectrum. Antoniades et al disclosed tabular grain emulsions in which tabular grains having {111} major faces account for greater than 97 percent of total grain projected area. The tabular grains have an equivalent circular diameter (ECD) of at least 0.7 μm and a mean thickness of less than 0.07 μm. Tabular grain emulsions with mean thicknesses of less than 0.07 μm are herein referred to as "ultrathin" tabular grain emulsions. They are suited for use in color photographic elements, particularly in minus blue recording emulsion layers, because of their efficient utilization of silver, attractive speed-granularity relationships, and high levels of image sharpness, both in the emulsion layer and in underlying emulsion layers.

A characteristic of ultrathin tabular grain emulsions that sets them apart from other tabular grain emulsions is that they do not exhibit reflection maxima within the visible spectrum, as is recognized to be characteristic of tabular grains having thicknesses in the 0.18 to 0.08 μm range, as taught by Buhr et al, *Research Disclosure*, Vol. 253, Item 25330, May 1985. *Research Disclosure* is published by Kenneth Mason Publications, Ltd., Dudley House, 12 North St., Emsworth, Hampshire P010 7DQ, England. In multilayer photographic elements overlying emulsion layers with mean tabular grain thicknesses in the 0.18 to 0.08 μm range require care in selection, since their reflection properties differ widely within the visible spectrum. The choice of ultrathin tabular grain emulsions in building multilayer photographic elements eliminates spectral reflectance dictated choices of different mean grain thicknesses in the various emulsion layers overlying other emulsion layers. Hence, the use of ultrathin tabular grain emulsions not only allows improvements in photographic performance, it also offers the advantage of simplifying the construction of multilayer photographic elements.

RELATED PATENT APPLICATIONS

Daubendiek et al U.S. Ser. No. 08/359,251, filed Dec. 19, 1994, allowed, and commonly assigned, titled EPITAXIALLY SENSITIZED ULTRATHIN TABULAR GRAIN EMULSIONS, (Daubendiek et al I) discloses photographic performance advantages in chemically and spectrally sensitized ultrathin tabular grain emulsions in which the chemical sensitization includes silver salt protrusions forming epitaxial junction with the ultrathin tabular grains. Daubendiek et al I is a continuation-in-part of Daubendiek et al II and III.

Daubendiek et al U.S. Ser. No. 08/297,430, filed Aug. 26, 1994, allowed, and commonly assigned, titled ULTRATHIN TABULAR GRAIN EMULSIONS CONTAINING SPEED- GRANULARITY ENHANCEMENTS, (Daubendiek et al II) observes in addition to the photographic performance advantages herein disclosed improvements in speed-granularity relationships attributable to the combination of chemical sensitizations including silver salt epitaxy and iodide distributions in the host tabular grains profiled so that the higher iodide host grain concentrations occur adjacent the corners and edges of the tabular grains and preferentially receive the silver salt epitaxy.

Daubendiek et al U.S. Ser. No. 08/297,195, filed Aug. 26, 1994, and commonly assigned, titled ULTRATHIN TABULAR GRAIN EMULSIONS WITH SENSITIZATION ENHANCEMENTS, (Daubendiek et al III) observes additional photographic advantages, principally increases in speed and contrast, to be realized when the iodide concentration of the silver halide epitaxy on silver iodobromide ultrathin tabular grains is increased.

Olm et al U.S. Ser. No. 08/296,562, filed Aug. 26, 1994, allowed, and commonly assigned, titled ULTRATHIN TABULAR GRAIN EMULSIONS WITH NOVEL DOPANT MANAGEMENT, discloses an improvement on the emulsions of this invention and those of Daubendiek et al II and III in which a dopant is incorporated in the silver salt epitaxy.

Wen U.S. Ser. No. 08/268,362, filed Jun. 30, 1994, and commonly assigned, titled ULTRATHIN TABULAR GRAIN EMULSION now U.S. Pat. No. 5,470,698 discloses dump iodide ultrathin tabular grain emulsions in which at least 25 percent of total silver lies in a peripheral portion of the tabular grains laterally surrounding an annular region that contains the dump iodide.

PROBLEM TO BE SOLVED

Notwithstanding the many advantages of tabular grain emulsions in general and the specific improvements represented by ultrathin tabular grain emulsions and color photographic elements, including those disclosed by Antoniades et al, there has remained an unsatisfied need for performance improvements in ultrathin tabular grain emulsions heretofore unavailable in the art as well as photographic elements containing these emulsions and for alternative choices for constructing emulsions and photographic elements of the highest attainable performance characteristics for color photography.

In addition there is a need in the art for ultrathin tabular grain emulsions that are "robust", where the term "robust" is employed to indicate the emulsion remains close to aim (i.e., planned) photographic characteristics despite inadvertent manufacturing variances. It is not uncommon to produce photographic emulsions that appear attractive in terms of their photographic properties when produced under laboratory conditions only to find that small, inadvertent variances in manufacturing procedures result in large quantities of emulsions that depart from aim characteristics to such an extent they cannot satisfy commercial requirements. There is in the art a need for high performance tabular grain emulsions that exhibit high levels of robustness or aim inertia, varying little from aim photographic characteristics from one manufacturing run to the next.

SUMMARY OF THE INVENTION

In one aspect the invention is directed to a radiation-sensitive emulsion comprised of (i) a dispersing medium, (ii) silver halide grains including tabular grains (a) having {111} major faces, (b) containing greater than 70 mole percent bromide and at least 0.5 mole percent iodide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and (iii) a spectral sensitizing dye adsorbed to the surfaces of the tabular grains, wherein (g) the tabular grains are comprised of tabular grains each having a central region extending between the {111} major faces and at least one laterally displaced region also extending between the {111} major faces having a higher iodide concentration than the central region, the tabular grains containing the laterally displaced region being capable of producing, when exposed to 325 nm electromagnetic radiation at 6° K., a stimulated fluorescent emission at 600 nm that is at least 2 percent of the maximum intensity of the stimulated fluorescent emission in the wavelength range of from 490 to 650 nm and (h) the surface chemical sensitization sites include at least one silver halide epitaxially located on said tabular grains.

In another aspect this invention is directed to a photographic element comprised of (i) a support, (ii) a first silver halide emulsion layer coated on the support and sensitized to produce a photographic record when exposed to specular light within the minus blue visible wavelength region of from 500 to 700 nm, and (iii) a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an improved emulsion according to the invention.

The ultrathin tabular grain emulsions of the present invention are the first to employ silver halide epitaxy in their chemical sensitization. The present invention has been realized by (1) overcoming a bias in the art against applying silver halide epitaxial sensitization to ultrathin tabular grain emulsions, (2) observing improvements in performance as compared to ultrathin tabular grain emulsions receiving only conventional sulfur and gold sensitizations, and (3) observing larger improvements in sensitivity than expected, based on similar sensitizations of thicker tabular grains.

Conspicuously absent from the teachings of Antoniades et al are demonstrations or suggestions of the suitability of silver salt epitaxial sensitizations of the ultrathin tabular grain emulsions therein disclosed. Antoniades et al was, of course, aware of the teachings of Maskasky I, but correctly observed that Maskasky I provided no explicit teaching or examples applying silver salt epitaxial sensitizations to ultrathin tabular grain emulsions. Having no original observations to rely upon and finding no explicit teaching of applying silver salt sensitization to ultrathin tabular grain emulsions, Antoniades et al was unwilling to speculate on the possible suitability of such sensitizations to the ultrathin tabular grain emulsions disclosed. The much larger surface to volume ratios exhibited by ultrathin tabular grains as compared to those employed by Maskasky I in itself was enough to raise significant doubt as to whether the ultrathin structure of the tabular grains could be maintained during epitaxial silver salt deposition. Further, it appeared intuitively obvious that the addition of silver salt epitaxy to ultrathin tabular grain emulsions would not improve image sharpness, either in the emulsion layer itself or in an underlying emulsion layer.

It has been discovered that chemical sensitizations including silver halide epitaxy are not only compatible with ultrathin host tabular grains, but that the resulting emulsions show improvements which were wholly unexpected, either in degree or in kind.

Specifically, increases in sensitivity imparted to ultrathin tabular grain emulsions by silver halide epitaxy have been observed to be larger than were expected based on the observations of Maskasky I employing thicker tabular host grains. Further, when these chemical sensitizations are combined with ultrathin tabular grains having non-uniform iodide distributions of the type identified above, the highest attainable photographic speeds can be realized.

Additionally, the emulsions of the invention exhibit higher than expected contrasts.

At the same time, the anticipated unacceptable reductions in image sharpness, investigated in terms of specularity measurements, simply did not materialize, even when the quantities of silver halide epitaxy were increased well above the preferred maximum levels taught by Maskasky I.

Still another advantage is based on the observation of reduced unwanted wavelength absorption as compared to relatively thicker tabular grain emulsions similarly sensitized. A higher percentage of total light absorption was confined to the spectral region in which the spectral sensitizing dye or dyes exhibited absorption maxima. For minus blue sensitized ultrathin tabular grain emulsions native blue absorption was also reduced.

Finally, the emulsions investigated have demonstrated an unexpected robustness. It has been demonstrated that, when levels of spectral sensitizing dye are varied, as can occur during manufacturing operations, the silver halide epitaxially sensitized ultrathin tabular grain emulsions of the invention exhibit less variance in sensitivity than comparable ultrathin tabular grain emulsions that employ only sulfur and gold sensitizers.

DESCRIPTION OF PREFERRED EMBODIMENTS

The invention is directed to an improvement in spectrally sensitized photographic emulsions. The emulsions are specifically contemplated for incorporation in camera speed color photographic films.

The emulsions of the invention can be realized by chemically and spectrally sensitizing any conventional ultrathin tabular grain emulsion in which the tabular grains (a) have {111} major faces;

(b) contain greater than 70 mole percent bromide, based on silver, (c) account for greater than 90 percent of total grain projected area;

(d) exhibit an average ECD of at least 0.7 μm; and (e) exhibit an average thickness of less than 0.07 μm.

Although criteria (a) through (e) are too stringent to be satisfied by the vast majority of known tabular grain emulsions, a few published precipitation techniques are capable of producing emulsions satisfying these criteria. Antoniades et al, cited above and here incorporated by reference, demonstrates preferred silver iodobromide emulsions satisfying these criteria. Zola and Bryant published European patent application 0 362 699 A3, also discloses silver iodobromide emulsions satisfying these criteria.

In addition to satisfying criteria (a) through (e) the emulsions of the invention are comprised of ultrathin tabular grains that exhibit enhanced sensitivity and improved sensitivity as a function of granularity (i.e., an improved speed-granularity relationship) by reason of containing a non-uniform distribution of iodide introduced as "dump iodide". As employed herein the term "dump iodide" indicates the addition of iodide occurs at the maximum feasible rate of addition. That is, the rate of iodide addition is not intentionally limited or reduced. In this approach the concentration of iodide incorporated into the grains during precipitation is abruptly increased by dumping into the reaction vessel in an increased concentration of iodide during the growth stage of precipitation. When iodide is introduced by a regulated rate of addition, which is otherwise characteristic of all halides introduced through silver halide precipitation, the iodide is referred to as "run iodide". It is also possible to introduce iodide by run addition during precipitation of the ultrathin tabular grains and to switch to an iodide dump or superimpose a iodide dump on the run iodide addition. These emulsions are referred to as "run dump" emulsions and are embraced within the term "dump iodide" to the extent they otherwise conform the criterion herein set out for dump iodide tabular grain emulsions.

Each ultrathin tabular grain formed by dump iodide addition contains a central region extending between its {111} major faces. Formed during dump iodide addition is a region laterally displaced from the central region also extending between the {111} major faces. The laterally displaced region contains a higher iodide concentration that the central region. However, it is not possible to identify a tabular grain formed by dump iodide addition merely by identifying a region containing an increased iodide concentration. It is alternatively possible to produce a laterally displaced region of increased iodide concentration merely by run iodide addition. Solberg et al, cited above, discloses both types of tabular grain structures.

While the differences between ultrathin tabular grain structures produced by run iodide and dump iodide approaches is not fully understood, there is clear evidence that the dump iodide approach produces a speed granularity relationship superior to that attainable with the run-iodide approach and there is clear evidence that this enhanced performance can be correlated with a differing crystal lattice structure. The differing crystal lattice structure produced by dump iodide addition can be demonstrated by the characteristic that the ultrathin tabular grain emulsions of invention, when exposed to 325 nm electromagnetic radiation at 6° K., exhibit a stimulated fluorescent emission at 600 nm that is at least 2 percent of the maximum intensity of the stimulated fluorescent emission in the wavelength range of from 490 to 650 nm. In fact, in preferred emulsions according to the invention in which all of the tabular grains are produced by dump iodide addition, fluorescent emission at 600 nm stimulated by 325 nm electromagnetic radiation is at least 5 percent (typically in the range of from >5 to 10 percent) of peak intensity fluorescent emission in the wavelength range of from 490 and 560 nm. It is therefore recognized that emulsions of the invention can include emulsions prepared by blending ultrathin tabular grain emulsions, provided at one of the ultrathin tabular grain emulsions is a dump iodide emulsion.

Although the criterion set forth above is the one herein principally relied upon to distinguish dump iodide from run iodide tabular grain structures, Chang et al U.S. Pat. Nos. 5,314,793 and 5,360,703, the disclosures of which are here incorporated by reference, set the distinguishing criterion as requiring dump iodide tabular grains to be capable of producing, when exposed to 325 nm electromagnetic radiation at 6° K., a stimulated fluorescent emission at 575 nm that is at least one third the intensity of an identically stimulated fluorescent emission maximum within the wavelength range of from 490 to 560 nm. It is also contemplated to rely on this latter criterion for distinguishing run iodide and dump iodide tabular grain emulsions.

In one preferred form of dump iodide tabular grain precipitation, set out by Solberg et al, cited above and here incorporated by reference, the central region of the ultrathin tabular grains accounts for from 75 to 97 percent of the total silver forming the ultrathin tabular grains and the laterally displaced region is a peripheral annular region accounting for the balance of the total silver.

In another preferred form of dump iodide tabular grain precipitation, set out by Wen, cited above, the central region accounts for at least 5 (preferably at least 10 and optimally at least 15) percent of total silver. An annular region extending between the {111} major faces corresponds to the dump iodide laterally displaced region disclosed above, and a peripheral region extending between the {111} major faces laterally surrounds the central region. The annular region accounts for from 0.5 to 25 (preferably 10 and optimally 5) percent of total silver, and the peripheral region accounts for the balance of total silver.

The tabular grains exhibit a face centered cubic crystal lattice structure formed by silver and halide ions. Bromide ions constitute at least 50 mole percent, based on total silver, and iodide ions constitute at least 0.5 mole percent of total silver. Over-all iodide ion concentrations of up to about 15 mole percent, based on total silver, are contemplated, with maximum iodide concentrations of up to about 10 mole percent being preferred for the vast majority of photographic applications. It is generally preferred that the minimum overall iodide concentration in the emulsions of the invention be at least 1 mole percent, based on total silver.

In one specifically preferred form the emulsions of the present invention are silver iodobromide emulsions. In referring to grains and/or emulsions containing more than one halide, the halides are in every instance named in order of ascending concentrations.

It is possible to include minor amounts of chloride ion in the emulsions of the invention. As disclosed by Delton U.S. Pat. No. 5,372,927, here incorporated by reference, and Delton U.S. Ser. No. 238,119, filed May 4, 1994, titled CHLORIDE CONTAINING HIGH BROMIDE ULTRATHIN TABULAR GRAIN EMULSIONS (now abandoned in favor of continuation-in-part U.S. Ser. No. 304,034, filed Sep. 9, 1994, now U.S. Pat. No. 5,460,934) both commonly assigned, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (°C.) boundaries of Curve A (preferably within the boundaries of Curve B) of Piggin et al U.S. Pat. Nos. 5,061,609 and 5,061,616, the disclosures of which are here incorporated by reference. Under these conditions of precipitation the presence of chloride ion actually facilitates reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

The ultrathin tabular grain region formed by dump iodide addition preferably contains at least a 1 mole percent higher iodide concentration than found in the central and, if present, peripheral portion of the grain. Iodide ion concentration in the portion of the grain formed by dump iodide addition is preferably in the range of from 5 to 20 mole percent iodide. The iodide introduced by dump iodide addition is the only required iodide in the emulsions of the invention. It is generally preferred that at least 0.5 and preferably greater than 1.0 mole percent of total halide, based on silver, be accounted for by iodide introduced during dump addition. The central and peripheral regions preferably contain less than 5 mole percent iodide and optimally less than 3 mole percent iodide.

The emulsions of the invention can be prepared by modifying known techniques for preparing ultrathin tabular grain emulsions satisfying the emulsion requirements of the invention, but lacking the teaching of an abrupt iodide introduction. The central and peripheral regions of the tabular grains can be precipitated employing known techniques for precipitating ultrathin tabular grain emulsions taught by Antoniades et al and Delton, both cited above; Daubendiek et al U.S. Pat. Nos. 4,414,310 and 4,693,964; *Research Disclosure*, August 1983, Item 23212, Example 1; and Zola and Bryant published European patent application 0 362 699, Examples 5 to 7; the disclosures of which are here incorporated by reference.

These precipitations are modified by abruptly introducing increased levels of iodide (i.e., dump iodide addition) after the central region has been precipitated. Abrupt iodide additions can be undertaken following the procedures taught by Solberg et al and Chang et al, both cited above and here incorporated by reference, and as demonstrated in the Examples below.

For reasons discussed below in connection with silver salt epitaxy the ultrathin tabular grains accounting for at least 90 percent of total grain projected area contain at least 70 mole percent bromide, based on silver. These ultrathin tabular grains include silver iodobromide, silver iodochlorobromide and silver chloroiodobromide grains. All references to the composition of the ultrathin tabular grains exclude the silver salt epitaxy.

The ultrathin tabular grains of the emulsions of the invention all have {111} major faces. Such tabular grains typically have triangular or hexagonal major faces. The tabular structure of the grains is attributed to the inclusion of parallel twin planes.

The tabular grains of the emulsions of the invention account for greater than 90 percent of total grain projected area. Ultrathin tabular grain emulsions in which the tabular grains account for greater than 97 percent of total grain projected area can be produced by the preparation procedures taught by Antoniades et al and are preferred. Antoniades et al reports emulsions in which substantially all (e.g., up to 99.8%) of total grain projected area is accounted for by tabular grains. Similarly, Delton reports that "substantially all" of the grains precipitated in forming the ultrathin tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area exhibit an average ECD of at least 0.7 μm. The advantage to be realized by maintaining the average ECD of at least 0.7 μm is demonstrated in Tables III and IV of Antoniades et al. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the ultrathin tabular grain emulsions of the invention the tabular grains accounting for greater than 90 percent of total grain projected area exhibit a mean thickness of less than 0.07 μm. At a mean grain thickness of 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by Antoniades et al these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of Antoniades et al, Kofron et al suggests a practical minimum tabular grain thickness about 0.01 μm.

Preferred ultrathin tabular grain emulsions are those in which grain to grain variance is held to low levels. Antoniades et al reports ultrathin tabular grain emulsions in which greater than 90 percent of the tabular grains have hexagonal major faces. Antoniades also reports ultrathin tabular grain emulsions exhibiting a coefficient of variation (COV) based on ECD of less than 25 percent and even less than 20 percent.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger ECD grains in the ultrathin tabular grain emulsions of the invention can produce a significant increase in emulsion granularity. Antoniades et al preferred low COV emulsions, since placing restrictions on COV necessarily draws the tabular grain ECD's present closer to the mean.

It is a recognition of this invention that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to modify the ultrathin tabular grain precipitation procedures taught by Antoniades et al to decrease selectively the size-frequency distribution of the ultrathin tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been discovered that disproportionate size range reductions in the size-frequency distributions of ultrathin tabular grains having greater than mean ECD's (hereinafter referred to as the $>ECD_{av.}$grains) can be realized by modifying the procedure for precipitation of the ultrathin tabular grain emulsions in the following manner: Ultrathin tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed. Maskasky U.S. Pat. No. 4,713,320 (hereinafter referred to as Maskasky II), here incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky II employ reduce methionine below detectable limits. Examples of agents that have been employed for oxidizing the methionine in gelatino-peptizers include NaOCl, chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfate of one of the following formulae:

$$R—SO_2S—M \quad (I)$$

$$R—SO_2S—R^1 \quad (II)$$

$$R—SO_2S—Lm—SSO_2—R^2 \quad (III)$$

where R, $R^1$ and $R^2$ are either the same or different and represent an aliphatic group, an aromatic group, or a heterocyclic group, M represents a cation, L represents a divalent linking group, and m is 0 or 1, wherein R, $R^1$, $R^2$ and L combine to form a ring. Gelatino-peptizers include gelatin—e.g., alkali-treated gelatin (cattle, bone or hide gelatin) or acid-treated gelatin (pigskin gelatin) and gelatin derivatives, e.g., acetylated or phthalated gelatin.

Although not essential to the practice of the invention, improvements in photographic performance compatible with the advantages elsewhere described can be realized by incorporating a dopant in the ultrathin tabular grains. As employed herein the term "dopant" refers to a material other than a silver or halide ion contained within the face centered cubic crystal lattice structure of the silver halide forming the ultrathin tabular grains. Although the introduction of dopants can contribute to the thickening of ultrathin tabular grains during their precipitation when introduced in high concentrations and/or before, during or immediately following grain nucleation, ultrathin tabular grains can be formed with dopants present during grain growth, as demonstrated in the Examples, wherein dopant introductions are delayed until after grain nucleation, introduced in prorated amounts early in grain growth and preferably continued into or undertaken entirely during the latter stage of ultrathin tabular grain growth. It has been also recognized from the teachings of Olm et al, cited above, that these same dopants can be introduced with the silver salt to be epitaxially deposited on the ultrathin tabular grains while entirely avoiding any risk of thickening the ultrathin tabular grains.

Any conventional dopant known to be useful in a silver halide face centered cubic crystal lattice structure can be employed. Photographically useful dopants selected from a wide range of periods and groups within the Periodic Table of Elements have been reported. As employed herein, references to periods and groups are based on the Periodic Table of Elements as adopted by the American Chemical Society and published in the *Chemical and Engineering News*, Feb. 4, 1985, p. 26. Conventional dopants include ions from periods 3 to 7 (most commonly 4 to 6) of the Periodic Table of Elements, such as Fe, Co, Ni, Ru, Rh, Pd, Re, Os, Ir, Pt, Mg, Al, Ca, Sc, Ti, V, Cr, Mn, Cu, Zn, Ga, Ge, As, Se, Sr, Y, Mo, Zr, Nb, Cd, In, Sn, Sb, Ba, La, W, Au, Hg, Tl, Pb, Bi, Ce and U. The dopants can be employed (a) to increase the sensitivity, (b) to reduce high or low intensity reciprocity failure, (c) to increase, decrease or reduce the variation of contrast, (d) to reduce pressure sensitivity, (e) to decrease dye desensitization, (f) to increase stability (including reducing thermal instability), (g) to reduce minimum density, and/or (h) to increase maximum density. For some uses any polyvalent metal ion is effective. The following are illustrative of conventional dopants capable of producing one or more of the effects noted above when incorporated in the silver halide epitaxy: B. H. Carroll, "Iridium Sensitization: A Literature Review", *Photographic Science and Engineering*, Vol. 24, No. 6, Nov./Dec. 1980, pp. 265–267; Hochstetter U.S. Pat. No. 1,951,933; De Witt U.S. Pat. No. 2,628,167; Spence et al U.S. Pat. No. 3,687,676 and Gilman et al U.S. Pat. No. 3,761,267; Ohkubo et al U.S. Pat. No. 3,890,154; Iwaosa et al U.S. Pat. No. 3,901,711; Yamasue et al U.S. Pat. No. 3,901,713; Habu et al U.S. Pat. No. 4,173,483; Atwell U.S. Pat. No. 4,269,927; Weyde U.S. Pat. No. 4,413,055; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Patent U.S. Pat. No. 4,835,093; Leubner et al U.S. Pat. No. 4,902,611; Inoue et al U.S. Pat. No. 4,981,780; Kim U.S. Pat. No. 4,997,751; Shiba et al U.S. Pat. No. 5,057,402; Maekawa et al U.S. Pat. No. 5,134,060; Kawai et al U.S. Pat. No. 5,153,110; Johnson et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Bell U.S. Pat. Nos. 5,252,451 and 5,252,530; Komorita et al EPO 0 244 184; Miyoshi et al EPO 0 488 737 and 0 488 601; Ihama et al EPO 0 368 304; Tashiro EPO 0 405 938; Murakami et al EPO 0 509 674 and 0 563 946 and Japanese Patent Application Hei-2[1990]-249588 and Budz WO 93/02390.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, tellurocyanate, nitrosyl, thionitrosyl, azide, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781 and 5,037,732, Marchetti et al U.S. Pat. No. 4,937,180, Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320. Olm et al U.S. Pat. No. 5,360,712, the disclosure of which is here incorporated by reference, discloses hexacoordination complexes containing organic ligands while Bigelow U.S. Pat. No. 4,092,171 discloses organic ligands in Pt and Pd tetra-coordination complexes.

It is specifically contemplated to incorporate in the ultrathin tabular grains a dopant to reduce reciprocity failure. Iridium is a preferred dopant for decreasing reciprocity failure. The teachings of Carroll, Iwaosa et al, Habu et al, Grzeskowiak et al, Kim, Maekawa et al, Johnson et al, Asami, Yoshida et al, Bell, Miyoshi et al, Tashiro and Murakami et al EPO 0 509 674, each cited above, are here incorporated by reference. These teachings can be applied to the emulsions of the invention merely by incorporating the dopant during silver halide precipitation.

In another specifically preferred form of the invention it is contemplated to incorporate in the face centered cubic crystal lattice of the ultrathin tabular grains a dopant capable of increasing photographic speed by forming shallow electron traps. *Research Disclosure*, Vol. 367, November 1994, Item 36736, contains a comprehensive description of the criteria for selecting shallow electron trapping (SET) dopants.

In a specific, preferred form it is contemplated to employ as a dopant a hexacoordination complex satisfying the formula:

$$[ML_6]^n \qquad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $(Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)\ (CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |

-continued

| | |
|---|---|
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the tabular grains and the silver in the protrusions. Generally shallow electron trap forming dopants are contemplated to be incorporated in concentrations of at least $1\times10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole. It is, of course, possible to distribute the dopant so that a portion of it is incorporated in the ultrathin tabular grains and the remainder is incorporated in the silver halide protrusions.

Subject to modifications specifically described below, preferred techniques for chemical and spectral sensitization are those described by Maskasky I, cited above and here incorporated by reference. Maskasky I reports improvements in sensitization by epitaxially depositing silver salt at selected sites on the surfaces of the host tabular grains. The term "epitaxy" is employed in its art-recognized usage to indicate the oriented growth of the silver salt on the host tabular grains, where the silver salt and tabular grains differ sufficiently in composition to exhibit a detectibly different crystal structure. In face centered cubic crystal lattice structure silver halides, detectable differences in halide compositions are known to be accompanied by differences in crystal lattice spacings. Maskasky I attributes the speed increases observed to restricting silver salt epitaxy deposition to a small fraction of the host tabular grain surface area. Specifically, Maskasky I teaches to restrict silver salt epitaxy to less than 25 percent, preferably less than 10 percent, and optimally less than 5 percent of the host grain surface area. Although the observations of this invention in general corroborate increasing photographic sensitivity as the percentage of host tabular grain surface area occupied by epitaxy is restricted, silver salt epitaxy has been found to be advantageous even when its location on the host tabular grains is not significantly restricted. This is corroborated by the teachings of Chen et al published European patent application 0 498 302, here incorporated by reference, which discloses high solubility silver halide protrusions on silver halide host tabular grains occupying up to 100 percent of the host tabular grain surface area. Therefore, in the practice of this invention restriction of the percentage of host tabular grain surface area occupied by silver salt epitaxy is viewed as a preference rather than a requirement of the invention. However, it is preferred that the silver salt epitaxy occupy less than 50 percent of the host tabular grain surface area.

Like Maskasky I, nominal amounts of silver salt epitaxy (as low as 0.05 mole percent, based on total silver, where total silver includes that in the host and epitaxy) are effective in the practice of the invention. Because of the increased host tabular grain surface area coverages by silver salt epitaxy discussed above and the lower amounts of silver in ultrathin tabular grains, an even higher percentage of the total silver can be present in the silver salt epitaxy. However, in the absence of any clear advantage to be gained by increasing the proportion of silver salt epitaxy, it is preferred that the silver salt epitaxy be limited to 50 percent of total silver. Generally silver salt epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver salt epitaxy that can be applied in forming the emulsions of this invention. Maskasky I teaches employing spectral sensitizing dyes that are in their aggregated form of adsorption to the tabular grain surfaces capable of direct silver salt epitaxy to the edges or corners of the tabular grains. Cyanine dyes that are adsorbed to host ultrathin tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

To avoid structural degradation of the ultra-thin tabular grains it is generally preferred that the silver salt epitaxy be of a composition that exhibits a higher overall solubility than the overall solubility of the silver halide or halides forming the ultrathin host tabular grains. The overall solubility of mixed silver halides is the mole fraction weighted average of the solubilities of the individual silver halides. This is one reason for requiring at least 70 mole percent bromide, based on silver, in the ultrathin tabular grains. Because of the large differences between the solubilities of the individual silver halides, the iodide content of the host tabular grains will in the overwhelming majority of instances be equal to or greater than that of the silver salt epitaxy. Silver chloride is a specifically preferred silver salt for epitaxial deposition onto the host ultrathin tabular grains. Silver chloride, like silver bromide, forms a face centered cubic lattice structure, thereby facilitating epitaxial deposition. There is, however, a difference in the spacing of the lattices formed by the two halides, and it is this difference that creates the epitaxial junction believed responsible for at least a major contribution to increased photographic sensitivity. To preserve the structural integrity of the ultrathin tabular grains epitaxial deposition is preferably conducted under conditions that restrain solubilization of the halide forming the ultrathin tabular grains. For example, the minimum solubility of silver bromide at 60° C. occurs between a pBr of between 3 and 5, with pBr values in the range of from about 2.5 to 6.5 offering low silver bromide solubilities. Nevertheless, it is contemplated that to a limited degree, the halide in the silver salt epitaxy will be derived from the host ultrathin tabular grains. Thus, silver chloride epitaxy containing minor amounts of bromide and, in some instances, iodide is specifically contemplated.

Silver bromide epitaxy on silver chlorobromide host tabular grains has been demonstrated by Maskasky I as an example of epitaxially depositing a less soluble silver halide on a more soluble host and is therefore within the contemplation of the invention, although not a preferred arrangement.

Maskasky I discloses the epitaxial deposition of silver thiocyanate on host tabular grains. Silver thiocyanate epitaxy, like silver chloride, exhibits a significantly higher solubility than silver bromide, with or without minor amounts of chloride and/or iodide. An advantage of silver thiocyanate is that no separate site director is required to achieve deposition selectively at or near the edges and/or corners of the host ultrathin tabular grains. Maskasky U.S. Pat. No. 4,471,050, incorporated by reference and hereinafter referred to as Maskasky III, includes silver thiocyanate epitaxy among various nonisomorphic silver salts that can be epitaxially deposited onto face centered cubic crystal lattice host silver halide grains. Other examples of self-directing nonisomorphic silver salts available for use as epitaxial silver salts in the practice of the invention include β phase silver iodide, γ phase silver iodide, silver phosphates (including meta- and pyro-phosphates) and silver carbonate.

It is generally accepted that selective site deposition of silver salt epitaxy onto host tabular grains improves sensitivity by reducing sensitization site competition for conduction band electrons released by photon absorption on image-wise exposure. Thus, epitaxy over a limited portion of the major faces of the ultrathin tabular grains is more efficient than that overlying all or most of the major faces, still better is epitaxy that is substantially confined to the edges of the host ultrathin tabular grains, with limited coverage of their major faces, and still more efficient is epitaxy that is confined at or near the corners or other discrete sites of the tabular grains. The spacing of the corners of the major faces of the host ultrathin tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain.

If desired, all or a portion of the dopants described above for inclusion in the ultrathin tabular grains can alternatively be located in the silver salt epitaxy. Preferably, when dopants are to be incorporated, the silver salt epitaxy is silver halide.

Silver salt epitaxy can by itself or with dopants increase photographic speeds to levels comparable to those produced by substantially optimum chemical sensitization with sulfur and/or gold. Additional increases in photographic speed can be realized when the tabular grains with the silver salt epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver salt epitaxy sensitizations are contained in *Research Disclosure* December 1989, Item 308119, Section III. Chemical sensitization. Kofron et al illustrates the application of these sensitizations to tabular grain emulsions.

A specifically preferred approach to silver salt epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

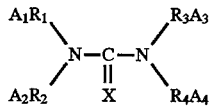

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VI)}$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver salt epitaxial deposition. Maskasky I teaches the use of aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogs that exhibit absorption maxima in the green and red portions of the spectrum, are particularly preferred for incorporation in the ultrathin tabular grain emulsions of the invention. A more general summary of useful spectral sensitizing dyes is provided by *Research Disclosure*, December 1989, Item 308119, Section IV. Spectral sensitization and desensitization, A. Spectral sensitizing dyes While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an ultrathin tabular grain according to the invention after chemical sensitization has been completed.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of the invention emulsions produce very large speed increases. This is in part attributable to relatively lower mean grain volumes and in part to the relatively higher mean grain surface areas available for spectral sensitizing dye adsorption.

Aside from the features of spectral sensitized, silver salt epitaxy sensitized ultrathin tabular grain emulsions described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Vol. 365, September 1994, Item 36544, Section I, Paragraph E, the disclosure of which is here incorporated by reference.

The emulsions once formed can be further prepared for photographic use by any convenient conventional technique. Additional conventional features are illustrated by *Research Disclosure* Item 36544, cited above, Section II, Vehicles, vehicle extenders, vehicle-like addenda and vehicle related addenda; Section III, Emulsion washing; Section V, Spectral sensitization and desensitization; Section VI, UV dyes/optical brighteners/luminescent dyes; Section VII, Antifoggants and stabilizers; Section VIII, Absorbing and scattering materials; Section IX, Coating physical property modifying addenda; Section X, Dye image formers and modifiers. The features of Sections VI, VIII, IX and X can alternatively be provided in other photographic element layers. Other features which relate to photographic element construction are found in Section XI, Layers and layer arrangements; XII, Features applicable only to color negative; XIII, Features applicable only to color reversal; XIV, Scan facilitating features; and XV, Supports.

The novel epitaxial silver salt sensitized ultrathin tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one important aspect this invention is directed to a photographic element containing at least two superimposed radiation sensitive silver halide emulsion layers coated on a conventional photographic support of any convenient type. The emulsion layer coated nearer the support surface is spectrally sensitized to produce a photographic record when the photographic element is exposed to specular light within the minus blue portion of the visible spectrum. The term "minus blue" is employed in its art recognized sense to encompass the green and red portions of the visible spectrum—i.e., from 500 to 700 nm. The term "specular light" is employed in its art recognized usage to indicate the type of spatially oriented light supplied by a camera lens to a film surface in its focal plane—i.e., light that is for all practical purposes unscattered.

The second of the two silver halide emulsion layers is coated over the first silver halide emulsion layer. In this arrangement the second emulsion layer is called upon to perform two entirely different photographic functions. The first of these functions is to absorb at least a portion of the light wavelengths it is intended to record. The second emulsion layer can record light in any spectral region ranging from the near ultraviolet (≧300 nm) through the near infrared (≦1500 nm). In most applications both the first and second emulsion layers record images within the visible spectrum. The second emulsion layer in most applications records blue or minus blue light and usually, but not necessarily, records light of a shorter wavelength than the first emulsion layer. Regardless of the wavelength of recording contemplated, the ability of the second emulsion layer to provide a favorable balance of photographic speed and image structure (i.e., granularity and sharpness) is important to satisfying the first function.

The second distinct function which the second emulsion layer must perform is the transmission of minus blue light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

How the overlying (second) emulsion layer can cause unsharpness in the underlying (first) emulsion layer is explained in detail by Antoniades et al, incorporated by reference, and hence does not require a repeated explanation.

It has been discovered that a favorable combination of photographic sensitivity and image structure (e.g., granularity and sharpness) are realized when silver salt epitaxy sensitized ultrathin tabular grain emulsions satisfying the requirements of the invention are employed to form at least the second, overlying emulsion layer. It is surprising that the presence of silver salt epitaxy on the ultrathin tabular grains of the overlying emulsion layer is consistent with observing sharp images in the first, underlying emulsion layer. Obtaining sharp images in the underlying emulsion layer is dependent on the ultrathin tabular grains in the overlying emulsion layer accounting for a high proportion of total grain projected area; however, grains having an ECD of less than 0.2 μm, if present, can be excluded in calculating total grain projected area, since these grains are relatively optically transparent. Excluding grains having an ECD of less than 0.2 μm in calculating total grain projected area, it is preferred that the overlying emulsion layer containing the silver salt epitaxy sensitized ultrathin tabular grain emulsion of the invention account for greater than 97 percent, preferably greater than 99 percent, of the total projected area of the silver halide grains.

Except for the possible inclusion of grains having an ECD of less than 0.2 μm (hereinafter referred to as optically transparent grains), the second emulsion layer consists almost entirely of ultrathin tabular grains. The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 97% and optimally greater than 99% of total grain projected area are satisfied excluding only grains having ECD's of less than 0.1 (optimally 0.05) μm. Thus, in the photographic elements of the invention, the second emulsion layer can consist essentially of tabular grains contributed by the ultrathin tabular grain emulsion of the invention or a blend of these tabular grains and optically transparent grains. When optically transparent grains are present, they are preferably limited to less than 10 percent and optimally less than 5 percent of total silver in the second emulsion layer.

The advantageous properties of the photographic elements of the invention depend on selecting the grains of the emulsion layer overlying a minus blue recording emulsion layer to have a specific combination of grain properties. First, the tabular grains preferably contain photographically significant levels of iodide. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of minus blue light when coupled with an average ECD of at least 0.7 μm and an average grain thickness of less than 0.07 μm. The mean ECD of at least 0.7 μm is, of course, advantageous apart from enhancing the specularity of light transmission in allowing higher levels of speed to be achieved in the second emulsion layer. Third, employing ultrathin tabular grains makes better use of silver and allows lower levels of granularity to be realized. Finally, the presence of silver salt epitaxy allows unexpected increases in photographic sensitivity to be realized.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The emulsions of the invention, their properties, and the procedures by which are formed can be better appreciated by reference to the following specific examples. Photographic speeds are reported as relative log speeds, where a speed difference of 30 log units equals a speed difference of 0.3 log E, where E represents exposure in lux-seconds. Speed was measured at a density of 0.15 above minimum density. Contrast is measured as mid-scale contrast. Halide ion concentrations are reported as mole percent (% M), based on silver.

EXAMPLE SERIES I

Ultrathin Emulsion A

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin was quickly oxidized by addition of 128 mg of Oxone™ ($2KHSO_5.KHSO_4.K_2SO_4$, purchased from Aldrich) in 20 cc of water, and the temperature was raised to 54° C. in 9 min. After the reactor and its contents were held at this temperature for 9 min, 100 g of oxidized methionine lime-processed bone gelatin dissolved in 1.5 L $H_2O$ at 54° C. were added to the reactor. Next the pH was raised to 5.90, and 122.5 cc of 1M NaBr were added to the reactor. Twenty four and a half minutes after nucleation the growth stage was begun during which 2.5M $AgNO_3$, 2.8M NaBr, and a 0.148M suspension of AgI (Lippmann) were added in proportions to maintain (a) a uniform iodide level of 4.125M % in the growing silver halide crystals and (b) the reactor pBr at the value resulting from the cited NaBr additions prior to the start of nucleation and growth, until 0.848 mole of silver iodobromide had formed (53.33 min, constant flow rates), at which time the excess $Br^-$ concentration was increased by addition of 105 cc of 1M NaBr; the reactor pBr was maintained at the resulting value for the balance of the growth. The flow of the cited reactants was then resumed and the flow was accelerated such that the final flow rate at the end of the segment was approximately 12.6 times that at the beginning; a total of 9 moles of silver iodobromide (4.125M % I) was formed. When addition of $AgNO_3$, AgI and NaBr was complete, the resulting emulsion was coagulation washed and the pH and pBr were adjusted to storage values of 6 and 2.5, respectively.

The resulting emulsion was examined by scanning electron micrography (SEM). More than 99.5% of the total grain projected area was accounted for by tabular grains. The mean ECD of the emulsion grains 1.89 μm, and their COV was 34. Since tabular grains accounted for very nearly all of the grains present, mean grain thickness was determined using a dye adsorption technique: The level of 1,1'-diethyl-2,2'-cyanine dye required for saturation coverage was determined, and the equation for surface area was solved assuming the solution extinction coefficient of this dye to be 77,300 L/mole-cm and its site area per molecule to be 0.566 $nm^2$.

This approach gave a mean grain thickness value of 0.053 μm.

Ultrathin Emulsion A'

Using the same general preparation approach described above for Emulsion A, Ultrathin Emulsion A' was prepared to provide an exact match (within the limits of measurement accuracy) of ECD and COV to that of Emulsion B, described below while retaining essentially the same mean grain thickness as Emulsion A. From the comparisons below it is apparent that there was little difference in the performance of Emulsions A and A' and hence the differences in ECD and COV between Emulsions A and B are not significant differences in terms of comparing ultrathin to thin tabular grain performance.

In Ultrathin Emulsion A' tabular grains accounted for greater than 95 percent of total grain projected area. The mean equivalent circular diameter (ECD) of the emulsion grains was 1.70 μm. This matched the mean ECD of Emulsion B (1.76 μm) within measurement error, ±0.07 μm. The COV of the grain ECD's in Ultra-thin Emulsion A' was 41 percent. This matched the COV of Emulsion B (44%), since the numerical difference is within measurement error ±4%.

Thin Emulsion B

This emulsion was precipitated exactly as Emulsion A to the point at which 9 moles of silver iodobromide had been formed, then 6 moles of the silver iodobromide emulsion were taken from the reactor. Additional growth was carried out on the 3 moles which were retained in the reactor to serve as seed crystals for further thickness growth. Before initiating this additional growth, 17 grams of oxidized methionine lime-processed bone gelatin in 500 cc water at 54° C. was added, and the emulsion pBr was reduced to ca. 3.3 by the slow addition of $AgNO_3$ alone until the pBr was about 2.2, followed by an unbalanced flow of $AgNO_3$ and NaBr. While maintaining this high pBr value and a temperature of 54° C., the seed crystals were grown by adding $AgNO_3$ and a mixed halide salt solution that was 95.875M % NaBr and 4.125M % KI until an additional 4.49 moles of silver iodobromide (4.125M % I) was formed; during this growth period, flow rates were accelerated 2× from start to finish. The resulting emulsion was coagulation washed and stored similarly as Emulsion A.

The resulting emulsion was examined similarly as Emulsion A. More than 99.5% of the total grain projected area was provided by tabular grains. The mean ECD of this emulsion was 1.76 μm, and their COV was 44. The mean thickness of the emulsion grains, determined from dye adsorption measurements like those described for Emulsion A, was 0.130 μm.

Sensitizations

Samples of the emulsions were next sensitized with and without silver salt epitaxy being present.

Epitaxial Sensitization Procedure

A 0.5 mole sample of the emulsion was melted at 40° C. and its pBr was adjusted to ca. 4 with a simultaneous addition of $AgNO_3$ and KI solutions in a ratio such that the small amount of silver halide precipitated during this adjustment was 12% I. Next, 2M % NaCl (based on the original amount of silver iodobromide host) was added, followed by addition of spectral sensitizers Dye 1 [anhydro-9-ethyl-5',6'-dimethyoxy-5-phenyl-3'-(3-sulfopropyl)-3-(3-sulfobutyl) oxathiacarbocyanine hydroxide] and Dye 2 [anhydro-5,5'-dichloro-9-ethyl-3,3'-bis(3-sulfopropyl)thiacarbocyanine hydroxide, sodium salt], after which 6M % AgCl epitaxy was formed by a balanced double jet addition of $AgNO_3$ and NaCl solutions. This procedure produced epitaxial growths mainly on the corners and edges of the host tabular grains.

The epitaxially sensitized emulsion was split into smaller portions in order to determine optimal levels of subsequently added sensitizing components, and to test effects of level variations. The post-epitaxy components included additional portions of Dyes 1 and 2, 60 mg NaSCN/mole Ag, $Na_2S_2O_3.5H_2O$ (sulfur), $KAuCl_4$ (gold), and 11.44 mg 1-(3-acetamidophenyl)-5-mercaptotetrazole (APMT)/mole Ag. After all components were added the mixture was heated to 60° C. to complete the sensitization, and after cool-down, 114.4 mg additional APMT was added.

The resulting sensitized emulsions were coated on a cellulose acetate film support over a gray silver antihalation layer, and the emulsion layer was overcoated with a 4.3 g/m$^2$ gelatin layer containing surfactant and 1.75 percent by weight, based on total weight of gelatin, of bis (vinylsulfonyl)methane hardener. Emulsion laydown was 0.646 g Ag/m$^2$ and this layer also contained 0.323 g/m$^2$ and 0.019 g/m$^2$ of Couplers 1 and 2, respectively, 10.5 mg/m$^2$ of 4-hydroxy-6-methyl-1,3,3a,7-tetraazaindene ($Na^+$ salt), and 14.4 mg/m$^2$ 2-(2-octadecyl)-5-sulfohydroquinone ($Na^+$ salt), surfactant and a total of 1.08 g gelatin/m$^2$. The emulsions so coated were given 0.01 sec Wratten 23A™ filtered (wavelengths >560 nm transmitted) daylight balanced light exposures through a calibrated neutral step tablet, and then were developed using the color negative Kodak Flexicolor™ C41 process. Speed was measured at a density of 0.15 above minimum density.

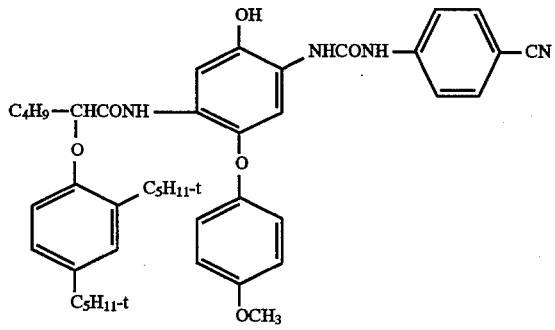

Coupler 1

-continued

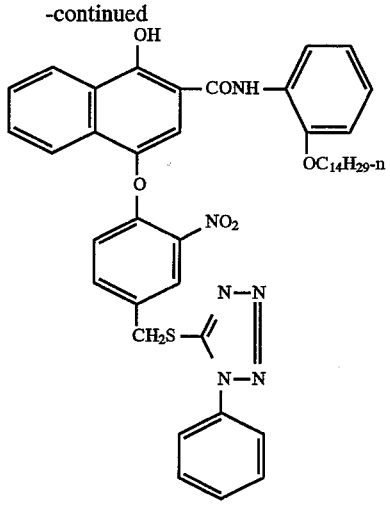

Coupler 2

Nonepitaxial Sensitization Procedure

This sensitization procedure was similar to that described for epitaxial sensitizations, except that the epitaxial deposition step was omitted. Thus after adjusting the initial pBr to ca. 4, suitable amounts of Dye 1 and Dye 2 were added, then NaSCN, sulfur, gold and APMT were added as before, and this was followed by a heat cycle at 60° C.

Optimization

Beginning levels for spectral sensitizing dye, sulfur and gold sensitizers were those known to be approximately optimal from prior experience, based on mean grain ECD and thickness. Sensitization experiments were then conducted in which systematic variations were made in levels of dye, sulfur and gold. Reported below in Tables I and II are the highest speeds that were observed in sensitizing the thin and ultrathin tabular grain emulsions A and B, respectively. In Table III the contrasts are reported of the epitaxially sensitized thin and ultrathin tabular grain emulsions A and B reported in Tables I and II.

TABLE I

Speed Increase Attributable to Epitaxy on Thin Host Tabular Grains

| Host Emulsion | Type of Sensitization | D min | Relative Log Speed |
|---|---|---|---|
| Emulsion B | Nonepitaxial | 0.11 | 100 |
| Emulsion B | Epitaxial | 0.15 | 130 |

TABLE II

Speed Increase Attributable to Epitaxy on Ultrathin Tabular Grains

| Host Emulsion | Type of Sensitization | D min | Relative Log Speed |
|---|---|---|---|
| Emulsion A | Nonepitaxial | 0.14 | 100 |
| Emulsion A | Epitaxial | 0.15 | 150 |
| Emulsion A' | Nonepitaxial | 0.13 | 100 |
| Emulsion A' | Epitaxial | 0.17 | 153 |

TABLE III

| Emulsion | ECD (μm) | COV (%) | Speed Gain Imparted by Epitaxy (Δ log E) |
|---|---|---|---|
| A | 1.89 | 34 | 0.50 |
| A' | 1.70 | 41 | 0.53 |
| B | 1.76 | 44 | 0.30 |

TABLE IV

Contrast Comparisons of Epitaxially Sensitized Thin and Ultrathin Tabular Emulsions.

| Host Emulsion | Emulsion Type | Sensitization | Contrast |
|---|---|---|---|
| Emulsion B | Thin | Epitaxial | 0.68 |
| Emulsion A | Ultrathin | Epitaxial | 0.89 |

Tables I, II and III demonstrate that the speed gain resulting from epitaxial sensitization of an ultrathin tabular grain emulsion is markedly greater than that obtained by a comparable epitaxial sensitization of a thin tabular grain emulsion. Table IV further demonstrates that the epitaxially sensitized ultrathin tabular grain emulsion further exhibits a higher contrast than the similarly sensitized thin tabular grain emulsion.

Specularity Comparisons

The procedure for determining the percent normalized specular transmittance of light through coatings of emulsions as outlined in Antoniades et al Example 6 was employed. Table V summarizes data for the spectrally and epitaxially sensitized thin and ultrathin tabular emulsions described above in terms of percent normalized specular transmittance (% NST), with normalized specular transmittance being the ratio of the transmitted specular light to the total transmitted light. The percent transmittance and the percent normalized specular transmittance at either 550 nm or 650 nm were plotted versus silver laydown. The silver laydown corresponding to 70 percent total transmittance was determined from these plots and used to obtain the percent specular transmittance at both 550 and 650 nm.

TABLE V

Specularity Comparisons

| Host | Sp. Sens. | M % AgCl | % NST | |
|---|---|---|---|---|
| Emulsion | Dyes | Epitaxy | 450 nm | 550 nm |
| thin Emulsion B | 1 & 2 | 6 | 20.7 | 18.6 |
| ultrathin Emulsion A | 1 & 2 | 6 | 70.7 | 71.6 |

From Table V it is apparent that epitaxially sensitized ultrathin tabular grain emulsions exhibit a dramatic and surprising increase in percentage of total transmittance accounted for by specular transmittance as compared to thin tabular grain emulsions.

Spectrally Displaced Absorptions

The same coatings reported in Table V that provided 70 percent total transmittance at 550 nm were additionally examined to determine their absorption at shorter wavelengths as compared to their absorption at the peak absorption wavelength provided by Dyes 1 and 2, which was 647 nm. The comparison of 600 nm absorption to 647 nm absorption is reported in Table VI, but it was observed that absorptions at all off-peak wavelengths are lower with epitaxially sensitized ultrathin tabular grain emulsions than with similarly sensitized thin tabular grain emulsions.

TABLE VI

Relative Off-Peak Absorption

| Host Emulsion | Dyes | Mole % Epitaxy | Relative Absorption A600/A647 |
|---|---|---|---|
| thin Emulsion B | 1 & 2 | 6 | 0.476 |
| ultrathin Emulsion A | 1 & 2 | 6 | 0.370 |

From Table VI it is apparent that the spectrally and epitaxially sensitized ultrathin tabular grain emulsion exhibited significantly less off-peak absorption than the compared similarly sensitized thin tabular grain emulsion.

Emulsion C

This emulsion was prepared in a manner similar to that described for Emulsion A, but with the precipitation procedure modified to provide a higher uniform iodide concentration ($AgBr_{0.88}I_{0.12}$) during growth and a smaller grain size.

Measuring grain parameters similarly as for Emulsion A, it was determined that in Emulsion C 99.4% of the total grain projected area was provided by tabular grains, the mean grain ECD was 0.95 μm (COV=61), and the mean grain thickness was 0.049 μm.

Specularity as a function of Epitaxial Levels

Formation of AgCl epitaxy on the host ultrathin tabular grains of Emulsion C followed the general procedure described above for epitaxial sensitizations with flow rates typically such that 6 mole-% epitaxy formed per min, or higher. The emulsion samples were not sulfur or gold sensitized, since these sensitizations have no significant influence on specularity. In addition to spectral sensitizing Dye 2, the following alternative spectral sensitizing dyes were employed:

Dye 3: Anhydro-6,6'-dichloro-1,1'-diethyl-3,3'-bis(3-sulfopropyl)-5,5'-bis(trifluoromethyl)benzimidazole carbocyanine hydroxide, sodium salt;

Dye 4: Anhydro-5-chloro-9-ethyl-5'-phenyl-3'-(3-sulfobutyl)-3-(3-sulfopropyl)oxacarbocyanine hydroxide, triethylammonium salt;

Dye 5: Anhydro-5,5'-dichloro-3,3'-bis(3-sulfopropyl) thiacyanine hydroxide, triethylammonium salt.

Since epitaxial deposition produces stoichiometric related amounts of sodium nitrate as a reaction by-product, which, if left in the emulsion when coated, could cause a haziness that could interfere with optical measurements, these epitaxially treated emulsions were all coagulation washed to remove such salts before they were coated.

TABLE VII

The Effect of Differing Levels of Epitaxy on Specularity of Ultrathin Tabular Grain Emulsions

| Dye(s) | Mole % Epitaxy | % NST 450 nm | % NST 550 nm | % NST 650 nm |
|---|---|---|---|---|
| 2 | 0 | 71.4 | 68.4 | — |
| 2 | 12 | 65.7 | 67.0 | — |
| 2 | 24 | 65.7 | 61.4 | — |
| 2 | 36 | 64.0 | 64.3 | — |
| 2 | 100 | 50.7 | 52.9 | — |
| 3 & 4 | 0 | — | — | 59.3 |
| 3 & 4 | 12 | — | — | 57.1 |
| 5 | 0 | — | 62.9 | 60.9 |
| 5 | 12 | — | 57.6 | 57.7 |

Data in Table VII show that specularity observed for the host emulsion lacking epitaxy is decreased only slightly after epitaxy is deposited. Even more surprising is the high specularity that is observed with high levels of epitaxy. Note that specularity at 450 and 550 nm remains high as the level of epitaxy is increased from 0 to 100%. The percent normalized specular transmittance compares favorably with that reported by Antoniades et al in Table IV, even though Antoniades et al did not employ epitaxial sensitization. It is to be further noted that the acceptable levels of specular transmittance are achieved even when the level of epitaxy is either higher than preferred by Maskasky I or even higher than taught by Maskasky I to be useful.

Robustness Comparisons

To determine the robustness of the emulsions of the invention Emulsion A was sulfur and gold sensitized, with an without epitaxial sensitization, similarly as the emulsions reported in Table II, except that the procedure for optimizing sensitization was varied so that the effect of having slightly more or slightly less spectral sensitizing dye could be judged.

A preferred level of spectral sensitizing dye and sulfur and gold sensitizers was arrived at in the following manner: Beginning levels were selected based on prior experience with these and similar emulsions, so that observations began with near optimum sensitizations. Spectral sensitizing dye levels were varied from this condition to pick a workable optimum spectral sensitizing dye level, and sulfur and gold sensitization levels were then optimized for this dye level. The optimized sulfur ($Na_2S_2O_3.5H_2O$) and gold ($KAuCl_4$) levels were 5 and 1.39 mg/Ag mole, respectively.

With the optimized sulfur and gold sensitization selected, spectral sensitizing dye levels were varied to determine the degree to which differences in dye level affected emulsion sensitivity. The results are summarized in Table VIII.

TABLE VIII

Robustness Tests: Ultrathin Tabular Grain Emulsions Optimally Sulfur and Gold Sensitized Without Epitaxy

| Description | Dye 1 mM/Ag M | Dye 2 mM/Ag M | Rel. Speed | D min | Δ Speed |
|---|---|---|---|---|---|
| Mid Dye | 0.444 | 1.731 | 100 | 0.14 | check |
| High Dye | 0.469 | 1.827 | 117 | 0.14 | +17 |
| Low Dye | 0.419 | 1.629 | 84 | 0.15 | −16 |

For each one percent change in dye concentration speed varied 2.73 log speed units. When the speed variance was examined on a second occasion, a one percent concentration variance in spectral sensitizing dye resulted in a speed variation of 4.36 log speed units. The run to run variance merely served to reinforce the observed lack of robustness of the emulsions lacking epitaxy.

The experiments reported above were repeated, except that Emulsion A additionally received an epitaxial sensitization similarly as the epitaxialy sensitized emulsion in Table II. The optimized sulfur ($Na_2S_2O_3.5H_2O$) and gold ($KAuCL_4$) levels were 2.83 and 0.99 mg/Ag mole, respectively. The results are summarized in Table IX below:

TABLE IX

Robustness Tests: Ultrathin Tabular Grain Emulsions Optimally Sulfur and Gold Sensitized With Epitaxy

| Description | Dye 1 mM/Ag M | Dye 2 mM/Ag M | Rel. Speed | D min | Δ Speed |
|---|---|---|---|---|---|
| Mid Dye | 0.444 | 1.73 | 100 | 0.14 | check |
| High Dye | 0.469 | 1.83 | 107 | 0.15 | +7 |
| Low Dye | 0.419 | 1.63 | 91 | 0.13 | −9 |

For each one percent change in dye concentration speed varied only 1.31 log speed units. This demonstrated a large and unexpected increase in the robustness of the epitaxially sensitized ultrathin tabular grain emulsion.

EXAMPLE SERIES II

Host Ultrathin Tabular Grain Emulsion Preparations

All of the emulsions prepared were silver iodobromide ultrathin tabular grain emulsions exhibiting a mean ECD of 2.2±0.2 μm. Iodide amounting to 2.6 mole percent, based on silver, was progressively introduced (i.e., run) into the reaction vessel in all emulsion precipitations. Abrupt (i.e., dump) iodide introduction was additionally undertaken in the preparation of the emulsions other than Emulsion A by introducing a silver iodide Lippmann emulsion in an amount equal to 1.5M percent of total silver used during precipitation.

Emulsion A

This emulsion was prepared using only progressively introduced (i.e., run) iodide. The emulsion was prepared to provide a reference for photographic speed comparisons.

Six liters of distilled water with 7.5 g of oxidized gelatin and 0.7 mL of antifoaming agent were added to a reaction vessel equipped with efficient stirring. The solution in the reaction vessel was adjusted to 45° C., pH 1.8 and pAg 9.1. In the nucleation, 12 mmol of $AgNO_3$ and 12 mmol of NaBr+KI (98.5:1.5 molar ratio) solutions were simultaneously added to the vessel reactor at constant flow rates over a period of 4 seconds. The temperature was raised to 60° C. and 100 g of oxidized gelatin in 750 mL of distilled water were added to the solution. The pH was adjusted to 5.85 with NaOH and the pAg t 9.0 at 60° C. In the first growth period, 0.81 mol of 1.6M $AgNO_3$ and 0.81 mol of 1.75M NaBr solutions were added to the reactor at constant flow rates over a period of 40 min. Concurrently, 0.022 mol of Lippman AgI emulsion was also added at a constant flow rate. The Br:I molar ratio was 97.4:2.6 during this growth period. The pAg of the liquid emulsion was adjusted to 9.2 with NaBr at 60° C. In the second growth period, the precipitation was continued with the same 1.6M $AgNO_3$, 1.75M NaBr and Lippman AgI solutions and the same mode of addition except for the flow rates for the 1.6M $AgNO_3$ and 1.75M NaBr solutions being accelerated from 13 cc/min to 96 cc/min in a period of 57 minutes. Like in the first growth period, the Br:I molar ratio was maintained at 97.4:2.6. The total amount of emulsion precipitated was 6 moles. The emulsion was then coagulation washed.

Significant features of the emulsion are summarized in Table I below.

Emulsion B

This emulsion was prepared using the same run iodide addition as Emulsion A, but in addition abruptly introducing (i.e., dumping) additional iodide after introducing 98.5 percent of the silver.

The precipitation procedure of Emulsion B was identical to that of Emulsion A, except that 0.09 mole of Lippman AgI emulsion was added (dumped) to the liquid emulsion at the end of the second growth period. The amount of the AgI addition was 1.5 mol % of the total silver precipitation.

Significant features of the emulsion are summarized in Table I below.

Emulsion C

This emulsion was prepared using the same iodide additions as in Emulsion B, but shifting the step of abruptly introducing (i.e., dumping) additional iodide so that it occurred earlier in the precipitation—specifically after introducing 70 percent of the silver and prior to introducing the final 28.5 percent of the silver.

Significant features of the emulsion are summarized in Table I below.

Emulsion D

This emulsion was prepared using the same iodide additions as in Emulsion B, but shifting the step of abruptly introducing (i.e., dumping) additional iodide so that it occurred earlier in the precipitation—specifically after introducing 30 percent of the silver and prior to introducing the final 68.5 percent of the silver.

Significant features of the emulsion are summarized in Table I below.

TABLE I

| Emulsion | % Ag Before I Dump | Mean Grain Thickness (μm) |
|---|---|---|
| A | no dump I | 0.051 |
| B | 98.5 | 0.047 |
| C | 70 | 0.051 |
| D | 30 | 0.058 |

Confirmation of Dump Iodide Crystal Lattice Modifications

Samples of the ultrathin tabular grain emulsions, Emulsion A–D, where each exposed to 325 nm electromagnetic radiation while being maintained at a temperature of 6° K. Peak emission intensity was observed as well as emission intensity at 600 nm. Emission intensity at 600 nm as a percentage of peak emission intensity is summarized in Table II.

TABLE II

| Emulsion | 600 nm Intensity as % of Peak Intensity |
|---|---|
| A | 0.7 |
| B | 7.0 |
| C | 9.2 |
| D | 13.3 |

From Table II it is apparent that comparison Emulsion A, which was prepared without abrupt iodide introduction, exhibited low levels of photoluminescence at 600 nm as compared to the remaining ultrathin tabular grain emulsions.

Epitaxial Depositions

A portion of each of Emulsions A–D was set aside for comparison and epitaxial deposition was undertaken on a remaining portion of each of the emulsions.

Epitaxial deposition started with an adjustment of the host liquid emulsion to pAg 7.5 at 40° C. using 50 mM of $AgNO_3$ and 6 mM KI solutions. To the emulsion was added 2.4 mmol of anhyro-5,5'-dichloro-9-ethyl-3,3,'-di(3-sulfopropyl)thiacarbocyanine hydroxide triethyl ammonium salt (Dye A) and 0.08 mmol of 5-[di-(1-ethyl-2(1H)-β-naphtho[1,2]thiazolylidene)isopropylidene]-1,3-di(β-methoxyethyl)barbituric acid (Dye B), followed by a 20 minute hold. Next, 32 mmol of NaCl and 24 mmol of NaBr were added in the form of aqueous solutions, which were followed by an addition of 9.6 mmol of AgI Lippmann emulsion. Finally, 55 mL of 1.0M $AgNO_3$ was pumped into the emulsion. The emulsion efficiently mixed during the additions and the levels were based on each mole of host emulsion.

Sensitizations

The portions of Emulsions A–D that did not receive epitaxy were identically sensitized as follows:

The additions and steps in sequence were (for each Ag mole of emulsion) 150 mg of NaSCN, 2.1 mmol of Dye A and 0.07 mmol of Dye B, 18 μmol of the sulfur sensitizer dicarboxymethyldimethylthiourea (S-1), 6 μmol of the gold sensitizer auroustrimethyltriazolium thiolate (Au-1), a heat digestion at 65° C. for 15 minutes and 4.5 mmol of each of KI and $AgNO_3$ solutions.

The portions of Emulsions A–D that received epitaxy were identically sensitized as follows:

The additions and steps in sequence were 60 mg of NaSCN, 15 μmol of the sulfur sensitizer S-1, 5 μmol of the gold sensitizer Au-1, and heat digestion at 65° C. for 15 minutes.

Sensitometry

Sensitized samples of Emulsions A–D, with and without epitaxy, were identically coated on a photographic film support and evaluated for intrinsic and minus blue sensitivities. The coating format employed was emulsion (0.54 g $Ag/m^2$, 1.1 $g/m^2$ gelatin) blended with a mixture of 0.97 $g/m^2$ Coupler 1 (see Series I definition) and 1.1 $g/m^2$ gelatin, 1 g/Ag mole 4-hydroxy-6-methyl-1,3,3a,7-tetraazaindene, sodium salt, surfactant, 1.6 $g/m^2$ gelatin, and 1.75 percent by weight, based on the weight of total gelatin, of bis (vinylsulfonyl)methane. To determine intrinsic sensitivities samples were exposed for 1/100th second with 365 nm light source. To determine minus blue sensitivities samples were exposed for 1/100th second with 5500° K. daylight through a Wratten™ 23A filter (>560 nm transmission).

All exposed samples were processed for 3 minutes 15 seconds in a Kodak Flexicolor™ C41 color negative process.

The results are summarized in Table III. All of the samples exhibited a minimum density of less than 0.25.

TABLE III

| Emulsion | Mole % Ag Before I Dump | Relative Spectral Speed | Relative Intrinsic Speed |
|---|---|---|---|
| A | No Dump I | 100 | 100 |
| B | 98.5 | 4 | 32 |
| B + Epitaxy | 98.5 | 156 | 156 |
| C | 70 | 131 | 135 |
| C + Epitaxy | 70 | 149 | 151 |
| D | 30 | 112 | 119 |
| D + Epitaxy | 30 | 163 | 173 |

Solberg et al, cited above, teaches that abrupt (dump) iodide addition should be undertaken in the range of from 75 to 97 percent of silver precipitation. Emulsion B demonstrates that a large reduction in photographic sensitivity is encountered when iodide dump addition is delayed beyond the precipitation of 97 percent of tabular grain silver. However, quite surprisingly, this dramatic loss in speed is not only offset, but turned into a large speed gain when accompanied with epitaxial deposition according to the teachings of this invention. It is also quite surprising that high sensitivities are also realized when iodide dump addition occurs before 75 percent of the tabular grain silver halide has been precipitated. In every instance the combination of ultrathin host grains prepared by iodide dump addition and silver halide epitaxy produces superior levels of photographic sensitivity.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium, silver halide grains including tabular grains, said tabular grains (a) having {111} major faces, (b) containing greater than 70 mole percent bromide and at least 0.5 mole percent iodide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and a spectral sensitizing dye adsorbed to the surfaces of the tabular grains, wherein the tabular grains are comprised of tabular grains each having a central region extending between the {111} major faces and at least one laterally displaced region also extending between the {111} major faces having a higher iodide concentration than the central region, the tabular grains containing the laterally displaced region being capable of producing, when exposed to 325 nm electromagnetic radiation at 6° K., a stimulated fluorescent emission at 600 nm that is at least 2 percent of the maximum intensity of the stimulated fluorescent emission in the wavelength range of from 490 to 650 nm and the surface chemical sensitization sites include at least one silver halide epitaxially located on less than 50 percent of said tabular grains surfaces.

2. An emulsion according to claim 1 wherein the tabular grains account for greater than 97 percent of total grain projected area.

3. An emulsion according to claim 1 wherein the tabular grains are silver iodobromide grains.

4. An emulsion according to claim 1 wherein the silver halide is comprised of silver chloride.

5. An emulsion according to claim 1 wherein the silver halide is comprised of silver bromide.

6. An emulsion according to claim 1 wherein the silver halide is predominantly located adjacent at least one of the edges and corners of the tabular grains.

7. An emulsion according to claim 6 wherein the spectral sensitizing dye is an aggregated cyanine dye capable of acting as a site director for epitaxial deposition of the silver halide.

8. An emulsion according to claim 1 wherein the laterally displaced regions are annular regions and contain an iodide concentration that is at least 1 mole percent higher than that found in the central regions of the tabular grains.

9. An emulsion according to claim 1 wherein the annular regions account for from 0.5 to 25 percent of the total silver of tabular grains in which the annular regions are located.

10. An emulsion according to claim 9 wherein the annular regions account for from 0.5 to 5 percent of the total silver of tabular grains in which the annular regions are located.

11. An emulsion according to claim 1 wherein the laterally displaced region is an annular region that is formed after at least 5 percent and before 75 percent of the silver forming the tabular grains has been precipitated.

12. An emulsion according to claim 1 wherein the laterally displaced region is an annular region that is formed after at least 97 percent of the silver forming the tabular grains has been precipitated.

13. An emulsion according to claim 1 wherein the spectral sensitizing dye exhibits an absorption peak at wavelengths longer than 430 nm.

14. An emulsion according to claim 13 wherein the spectral sensitizing dye is a green or red spectral sensitizing dye.

15. An emulsion according to claim 1 wherein the tabular grains containing the laterally displaced region are capable of producing, when exposed to 325 nm electromagnetic radiation at 6° K., a stimulated fluorescent emission at 600 nm that is at least 5 percent of the maximum intensity of the stimulated fluorescent emission in the wavelength range of from 490 to 650 nm.

16. An emulsion according to claim 15 wherein the tabular grains containing the laterally displaced region are capable of producing, when exposed to 325 nm electromagnetic radiation at 6° K., a stimulated fluorescent emission at 600 nm that is from greater than 5 percent to 10 percent of the maximum intensity of the stimulated fluorescent emission in the wavelength range of from 490 to 650 nm.

17. A photographic element comprised of a support, a first silver halide emulsion layer coated on the support and sensitized to produce a photographic record when exposed to specular light within the minus blue visible wavelength region of from 500 to 700 nm, and a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an improved emulsion according to any one of claims 1, 2, 3, 4, 5 and 6 to 16 inclusive.

* * * * *